US006415463B1

(12) United States Patent
Slothower

(10) Patent No.: US 6,415,463 B1
(45) Date of Patent: Jul. 9, 2002

(54) DRAIN STOP AND OVERFLOW MECHANISM FOR A BATHTUB

(75) Inventor: Erich D. Slothower, Sheboygan, WI (US)

(73) Assignee: Kallista, Inc., Kohler, WI (US)

( * ) Notice: Subject to any disclaimer, the term of this patent is extended or adjusted under 35 U.S.C. 154(b) by 0 days.

(21) Appl. No.: 09/544,586

(22) Filed: Apr. 6, 2000

(51) Int. Cl.[7] ..... E03C 1/232
(52) U.S. Cl. ..... 4/688; 4/683; 4/686
(58) Field of Search ..... 4/680, 682–684, 4/686, 688

(56) References Cited

U.S. PATENT DOCUMENTS

| | | | | |
|---|---|---|---|---|
| 449,880 A | | 4/1891 | Hammann | |
| 498,093 A | | 5/1893 | Treiber | |
| 851,513 A | | 4/1907 | Guthrie et al. | |
| 1,117,716 A | | 11/1914 | Speakman | |
| RE13,943 E | | 7/1915 | Speakman | |
| 1,745,002 A | | 1/1930 | Brotz | |
| 1,781,719 A | * | 11/1930 | Darling | 4/683 |
| 1,867,725 A | | 7/1932 | Brotz | |
| D235,106 S | | 5/1975 | Doman | |

FOREIGN PATENT DOCUMENTS

| | | | | |
|---|---|---|---|---|
| CH | 64161 | * | 3/1913 | 4/686 |
| FR | 615872 | * | 1/1927 | 4/682 |
| IT | 520880 | * | 3/1955 | 4/683 |

* cited by examiner

*Primary Examiner*—Charles R. Eloshway
(74) *Attorney, Agent, or Firm*—Quarles & Brady LLP

(57) ABSTRACT

A drain stop and overflow mechanism that is particularly well-suited for use with a free-standing bathtub includes a drainpipe that can be connected to a water drain opening in the bathtub. A standpipe can be connected at a bottom end to a waste water line and also to the drainpipe. A sleeve provides an internal overflow system within the standpipe, and a plunger controlling drainage is positioned within the sleeve.

2 Claims, 3 Drawing Sheets

DRAIN STOP AND OVERFLOW MECHANISM FOR A BATHTUB

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to bathtubs and in particular to mechanisms for controlling the drainage of water from bathtubs.

There is a renewed interest in styling from past eras, such as the Victorian and Elizabethan periods. One such retro-style design is a free-standing bathtub located centrally in a bathroom. See e.g. U.S. Pat. No. D235,106.

Such designs support tubs on legs so that they are positioned sufficiently far away from a bathroom wall so that the tub is accessible from any side. However, this requires the plumbing conduits for filling and draining the bathtub to extend up from the floor and be exposed, rather than hidden in the wall. Thus, it is important to limit the amount of exposed plumbing to reduce cost, for aesthetic appearance, and for other reasons.

A standard feature of most bathtubs is an overflow drainage system which prevents the bathtub from being overfilled to the point that water will flow over the sides of the bathtub and onto the floor. Typical overflow systems provide an opening through an end wall near the top foot end of the bathtub, which is coupled to a waste drain via a lateral conduit. For a free-standing bathtub, this lateral conduit would be exposed, thereby adding to the cost of the bathtub and the adverse aesthetics.

One overflow mechanism designed for such a free-standing bathtub is disclosed in U.S. Pat. No. 851,513. This mechanism avoids the need for a separate overflow. It has an exposed standpipe coupled below the floor to a waste drain leading from the bottom of the bathtub. The standpipe houses a tubular valve that is operated by a lift knob extending up through the top of the standpipe. When the lift knob is completely lowered, the valve stem prevents water from exiting the bottom of the standpipe so that the bathtub can be filled (thereby eliminating the need for a drain stopper).

As the bathtub is filled, water passes through the waste drain and fills the standpipe outside of the valve tube. Because water always finds its own level, the water in the bathtub is at the same height as the water in the standpipe. When the water in the standpipe reaches the top of the valve tube (or alternatively holes in the valve tube), water drains down through the center of the valve stem. In this way, the water cannot overflow the bathtub and there is no need for a separate overflow port formed in a side wall of the bathtub.

However, in this early design as the water level rises in the tub more and more hydrostatic pressure acts against the side of the valve tube and along its sides. This causes a number of problems. For example, the lift knob becomes more difficult to raise and water is prone to leak past the valve seat. Further, this valve can be quite noisy.

There is still a need to improve the functional aspects of overflow mechanisms for such bathtubs.

BRIEF SUMMARY OF THE INVENTION

In one aspect the invention provides a drain stop and overflow mechanism for a basin having a water drain opening. There is a standpipe which is connectable at a lower end to a waste water line through a drain valve seat. There is also a drainpipe connectable at one end to the water drain opening of the basin and at another end to the standpipe.

A sleeve is positioned within the standpipe and extends upward to a selected overflow height. The sleeve has a lesser outer diameter than an inner diameter of the standpipe so that a passage exists therebetween. The sleeve also has a bottom end in fluid communication with the drainpipe, and, when the drain valve seat is not closed, also the waste water line.

There is also a plunger disposed within the sleeve and having a lower valve head and a stem extending upwardly therefrom to a lift element positioned over the standpipe. The valve head is removably positionable on the drain valve seat. A by-pass route connects a lower end of the passage and the waste water line.

Lifting the lift element can cause the valve head to move off of the drain valve seat. Further, when the valve head is on the drain valve seat water can rise within the sleeve, and then pass into the passage and then down past the drain valve seat into the waste water line.

In preferred forms, the standpipe is attached to the basin by a bracket, and the lift element is a knob that can be raised and then pivoted to engage a stop to prevent downward movement of the plunger.

Thus, the present invention provides an overflow and stopper mechanism that is particularly well-suited for use with a free-standing bathtub. It also can be used with pedestal lavatories and other basins.

It eliminates the need for an exposed a drain plug and also eliminates the need for a separate overflow hole and drainage system. This therefore reduces cost and provides a more appealing fixture. Additionally, the water column within the plunger sleeve acts to seat the valve head against the valve seat so that the mechanism is not prone to leakage. Moreover, the plunger stem can be a narrow rod such that it encounters little or no side force from the water leaving the basin.

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to ascertain the scope of the invention.

DETAILED DESCRIPTION OF THE PREFERRED EMBODIMENTS

Figure 1:
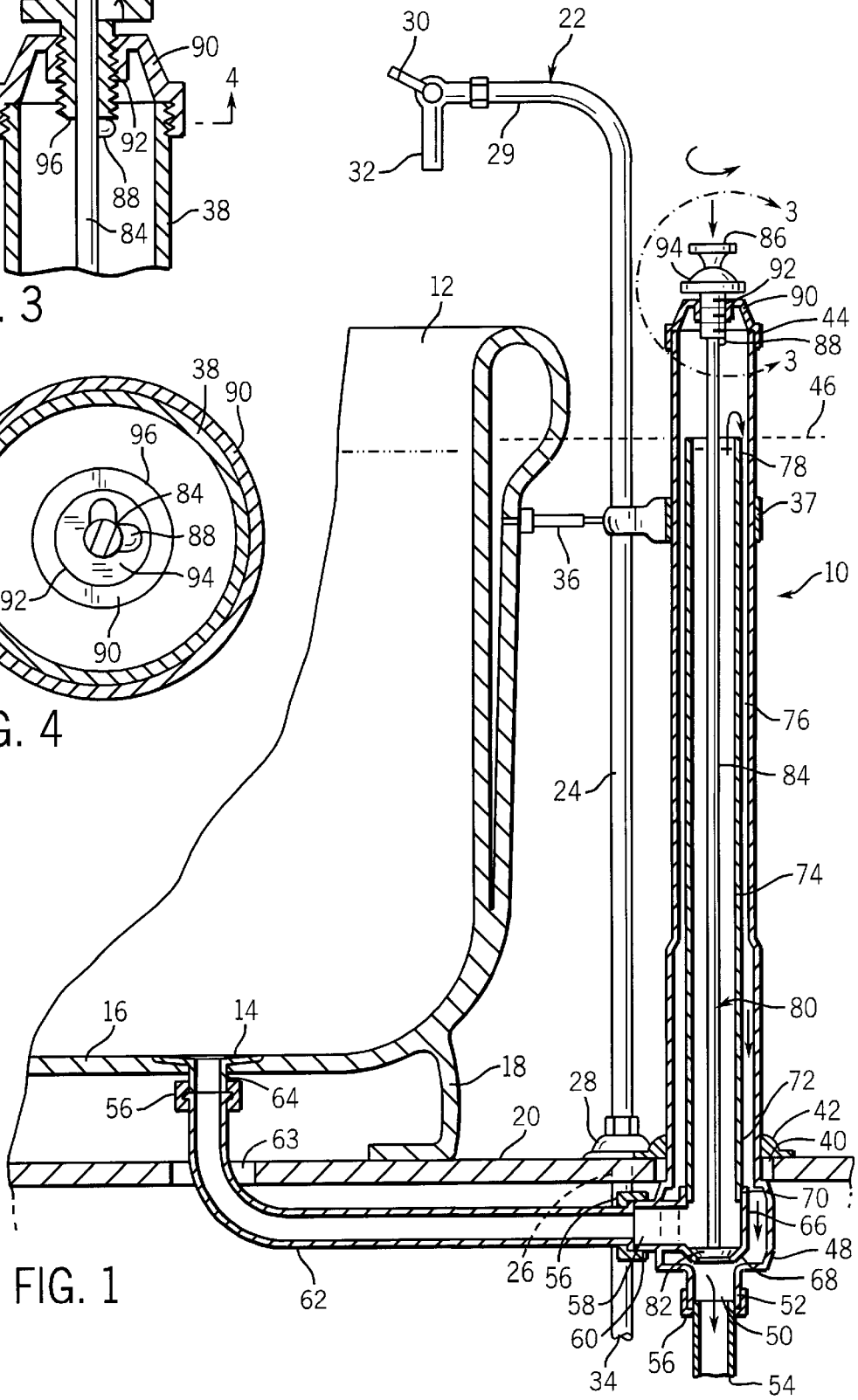
FIG. 1 is a partial side cross-sectional view of a drain and overflow mechanism of the present invention linked to a bathtub and with the plunger in the closed position.

Referring to FIG. 1, the drain stop and overflow mechanism (mechanism) of the present invention is referred to generally by reference numeral 10. The mechanism 10 can be used with a free-standing bathtub 12 having a drain opening 14 at its bottom 16 and legs 18 resting on a floor 20.

A bathtub faucet 22 has pair of upright tubes 24 (one shown) mounted at openings 26 in the floor 20 to annular mounting plates 28 mounted to the floor 20. The upright tubes 24 have bent ends 29 to which are attached a pair of handles 30 and a spigot 32 positioned over the bathtub 12. The upright tubes 24 house hot and cold water supply lines 34 extending up through the openings 26 in the floor 20.

The flow of water through the water supply lines 34 and out the spigot 32 is controlled by a valve operated by the handles 30. The tubes 24 are joined together and secured to the bathtub 12 by a T-shaped bracket 36. The bracket 36 includes a ring 37 at one end that fits around a standpipe 38 to secure the mechanism 10 to the bathtub 12. The faucet 22, bracket 36, and standpipe 38 are preferably chrome-plated brass.

Referring still to FIG. 1, the mechanism 10 includes the standpipe 38 mounted over another opening 40 in the floor 20 by another annular mounting plate 42. The standpipe 38 is generally cylindrical and extends to a top end 44 at a height above a maximum water level 46 of the bathtub 12. A bottom end 48 of the standpipe 38 sits below the floor 20 through the opening 40.

Figure 7:
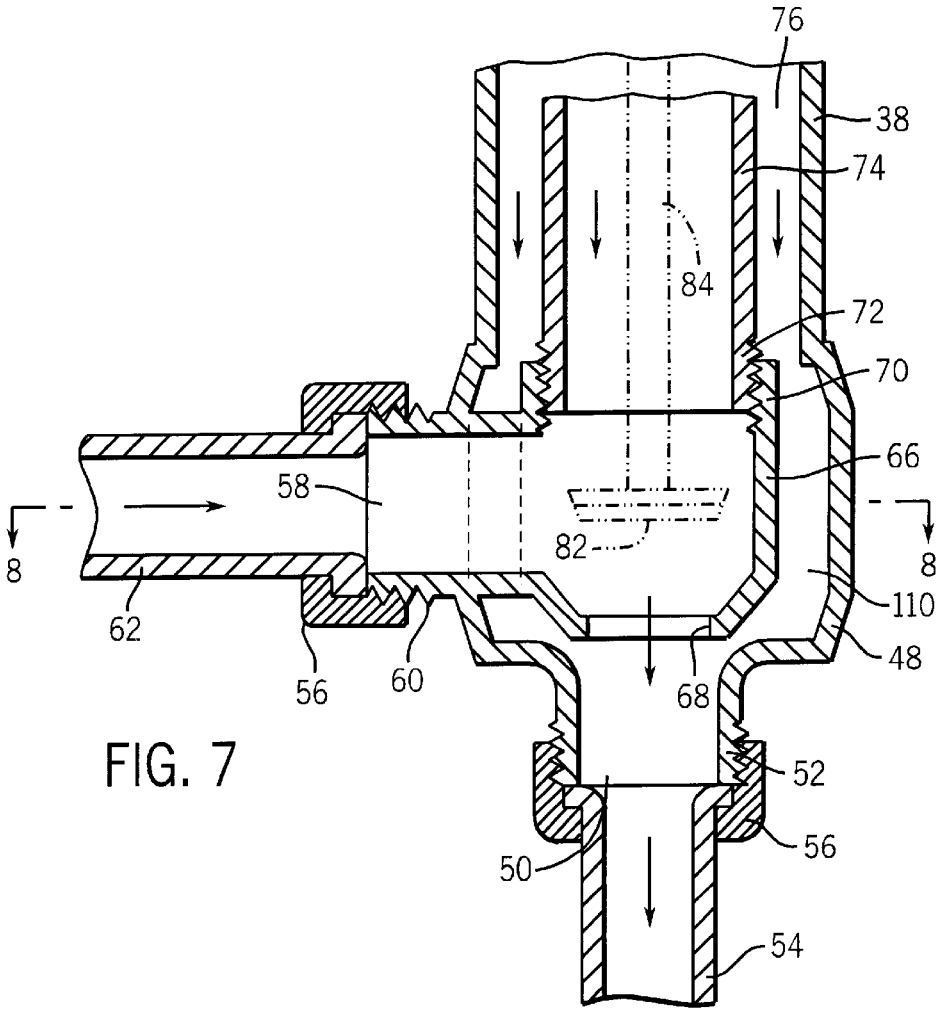
FIG. 7 is an enlarged sectional schematic view of the drain and by-pass area.
Figure 8:
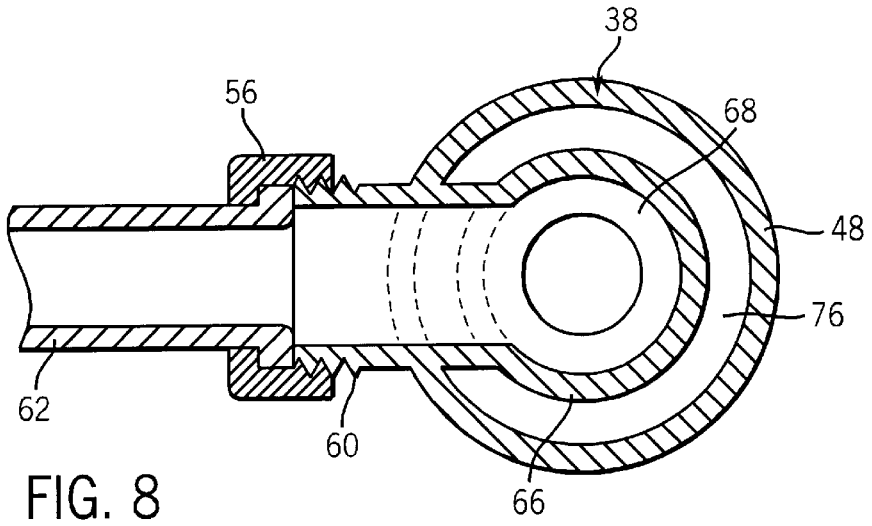
FIG. 8 is a cross-sectional view taken along line 8—8 of FIG. 7.

Referring to FIGS. 7 and 8, the bottom end 48 has a bottom axial opening 50 with a threaded neck 52 to which a waste water line 54 is coupled via a threaded collar 56. The bottom end 48 also has an radial opening 58 perpendicular to the axial opening 50 and having a threaded neck 60.

Referring to FIGS. 1, 7 and 8, an L-shaped drainpipe 62 is coupled to the threaded neck 60 at one end and to a threaded neck 64 of the drain opening 14 (through an opening 63 in the floor 20) at the other end by a pair of threaded collars 56. The threaded neck 60 of the radial opening 58 is integral with a coupler 66. The coupler 66 has an axial bottom opening defining a valve seat 68 with an inwardly tapered circumference. Opposite the valve seat 68 is a threaded opening 70 to which a threaded bottom end 72 of a cylindrical plunger sleeve 74 is disposed concentrically within the standpipe 38.

The sleeve 74 has a smaller outer diameter than the inner diameter of the standpipe 38 so that an annular passage 76 exists around the sleeve 74. The sleeve 74 extends from the coupler 66 beneath the floor 20 level up to a top end 78 at the maximum water level 46. The sleeve 74 houses a plunger 80 having a frustoconical valve head 82 and a narrow, rod-like stem 84 extending up through top end 44 of the standpipe 38 to a lift knob 86. Spaced down from the lift knob 86 is a travel stop 88 projecting radially outward from the stem 84.

Figure 3:
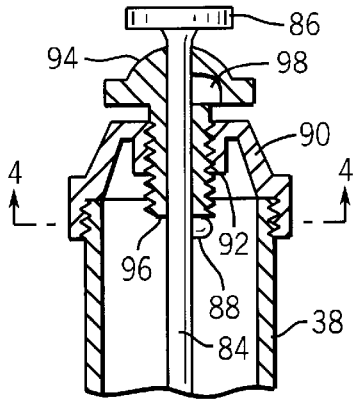
FIG. 3 is an enlarged detailed sectional view of a lift knob in the lowered position shown in FIG. 1.
Figure 6:
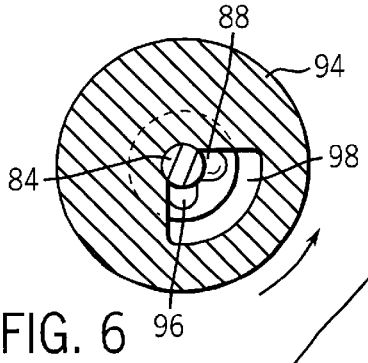
FIG. 6 is a sectional view taken along line 6—6 of FIG. 5.

Referring now to FIG. 3, a cap 90 is threaded to the top end 44 of the standpipe 38. The cap 90 includes a threaded axial bore 92 in which is disposed a bolt 94. The bolt 94 has an axial slot 96 through most of its length (expect at a top portion having an axial bore) and a radial groove 98 extending in arcuate path (approximately 90 degrees) beginning from the axial slot 96, as shown in FIG. 6. The axial slot 96 and radial groove 98 are sized to receive the travel stop 88 of the stem 84 when the plunger 80 is at the appropriate height and angular orientation (described below).

Figure 4:
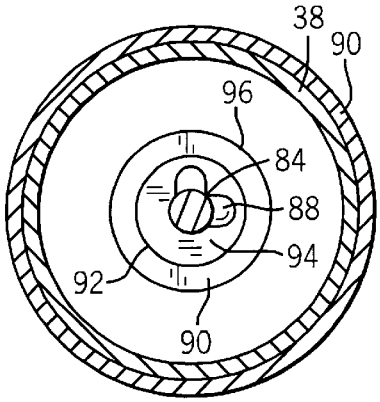
FIG. 4 is a cross-sectional view taken along line 4—4 of FIG. 3.

When the travel stop 88 is aligned with the axial slot 96, the plunger 80 can be lowered to a closed position by pushing down on the lift knob 86, such that the valve head 82 is seated in the valve seat 68, as shown in FIG. 1. Referring to FIGS. 3 and 4, the plunger 80 can be rotated so the that travel stop 88 is disposed directly beneath the bolt 94 so that the plunger 80 remains seated.

Figure 5:
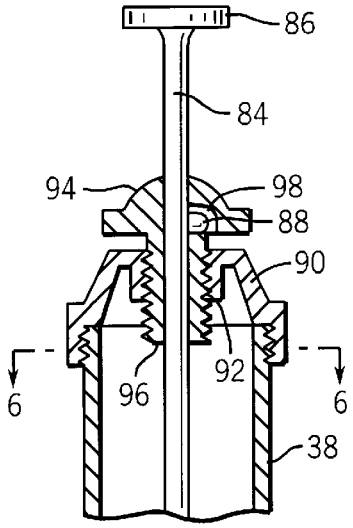
FIG. 5 is an enlarged view similar to FIG. 3, albeit of the lift knob in the raised position of FIG. 2.
Figure 2:
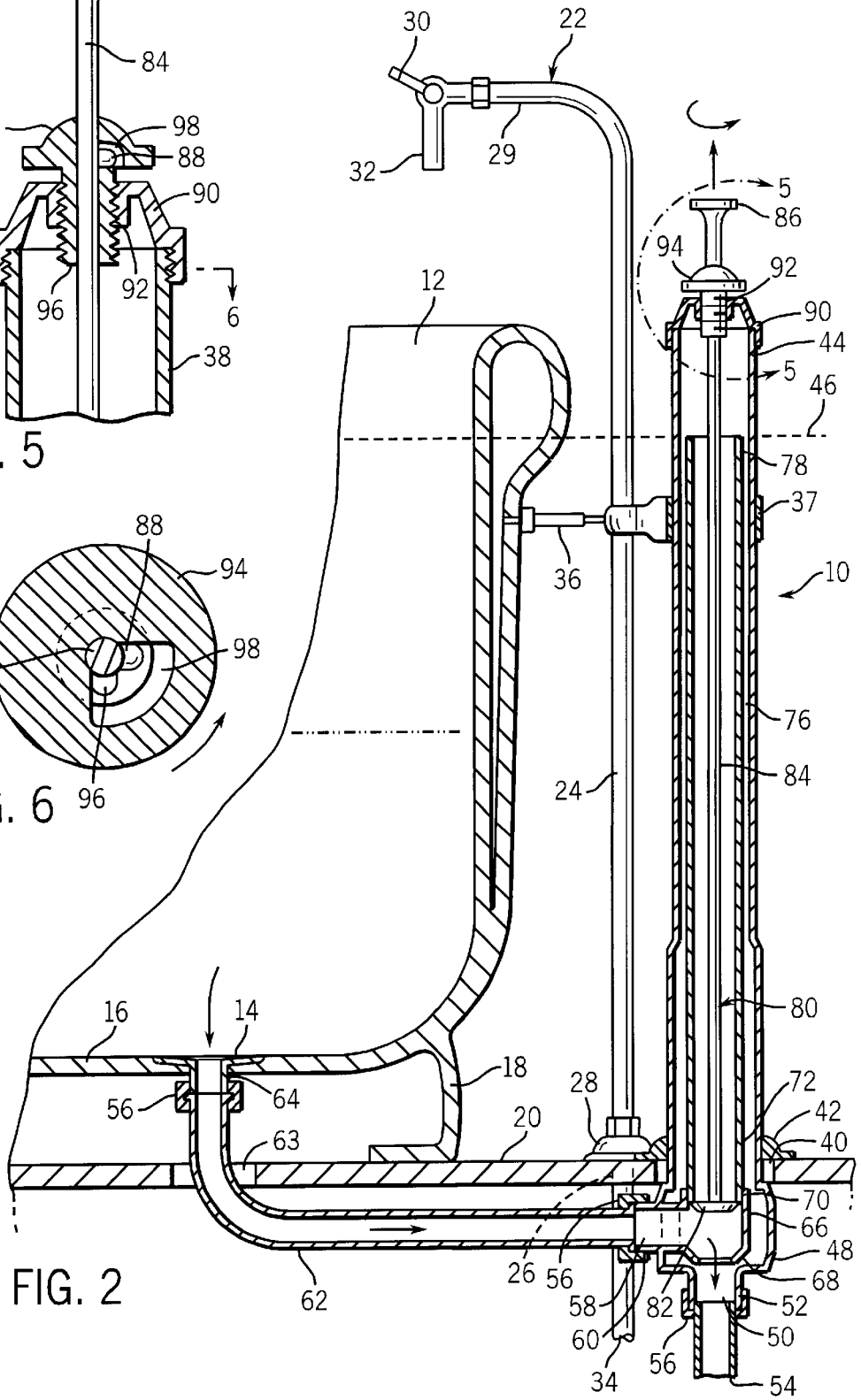
FIG. 2 is a view similar to FIG. 1, albeit showing the plunger in an open position allowing water to drain out of the bathtub.

With the plunger 80 raised to an open position, as shown in FIG. 2, the valve head 82 is no longer seated against the valve seat 68. Referring to FIGS. 5 and 6, when the plunger 80 is raised until the travel stop 88 hits the top of the axial slot 96, the plunger 80 can be rotated turning the lift knob 86 so that the travel stop 88 rests within the radial groove 98, thereby holding the plunger 80 in the open position.

When the plunger 80 is in the open position such that the valve head 82 is removed from the valve seat 68 water within the bathtub can be drained. Specifically, water within the bathtub 12 can drain through the drain opening 14 to the drainpipe 62 through to the coupler 66 and down through the bottom of the standpipe 38 to the waste water line 54.

When the plunger 80 is in the closed position such that the valve head 82 is seated against the valve seat 68, the mechanism 10 acts as a drain stopper so that the bathtub 12 can be filled. As water enters the bathtub 12 is passes through the drainpipe 62 to the coupler 66 and is forced up the center of the sleeve 74. The water column within the sleeve 74 acts to assist in positively holding the valve head 82 against the valve seat 68 thereby helping to avoid leakage.

Water can continue to fill the bathtub 12 and therefore sleeve 74 until the maximum water level 46 (i.e., the top of the sleeve 74) is reached. At that point, additional water entering the bathtub 12 will force water to spill out and around of the sleeve 74 preventing the overflow of the tub.

This excess water will pass between the sleeve and the standpipe 38, by-pass 110, and out the bottom axial opening 50 to the waste water line 54. In this way, the mechanism acts to prevent water from overflowing the sides of the bathtub 12 and spilling onto the floor 20.

Thus, the present invention provides an drain stop and overflow mechanism particularly well-suited for use with a free-standing bathtub. It will be evident from the above description to those skilled in the art that various changes and modifications can be made to the above described system without departing from the scope of the present invention. Accordingly, to ascertain the full scope of the invention, reference must be had to the following claims.

INDUSTRIAL APPLICABILITY

The above disclosure provides a bathtub overflow and drain stop mechanism.

I claim:

1. An assembly of a drain stop and overflow mechanism attached to a basin, comprising:

a basin having a water drain opening;

a standpipe attached to the basin which is connectable at a lower end opening to a waste water line;

a drainpipe connected at one end to the water drain opening of the basin and connected at another end to the standpipe;

a sleeve positioned within the standpipe and extending upward to a selected overflow height, the sleeve having a lesser outer diameter than an inner diameter of the standpipe so that a passage exists therebetween, the sleeve having a bottom end adjacent a drain valve seat, the bottom end being in fluid communication with the drainpipe, and, when the drain valve seat is not closed, also the lower end opening of the standpipe;

a plunger having a lower valve head and a stem extending upwardly therefrom through the entire sleeve to a lift element, the lift element extending above the standpipe outside the basin, the valve head being removably positionable on the drain valve seat; and a by-pass route connecting a lower end of the passage and the lower end opening of the standpipe;

whereby lifting the lift element can cause the valve head to move off of the drain valve seat;

wherein the valve head and standpipe are configured such that when the valve head is on the drain valve seat, a top surface of the valve head is essentially at or below the level of the top edge of the valve seat, so that the plunger encounters essentially no side force from water leaving the basin apart from contact of the water with the plunger stem;

wherein pushing down on the lift element drives the valve head to a seating position on the drain valve seat; and wherein when the valve head is on the drain valve seat water can rise within the sleeve, and then pass into the passage and then down past the drain valve seat through the lower end opening of the standpipe.

2. The assembly of claim 1, wherein the plunger further includes a stop at an upper end, and wherein the lift element is a knob that can be raised and then pivoted to engage the stop to prevent downward movement of the plunger.

* * * * *